US007506706B2

(12) United States Patent
Hall et al.

(10) Patent No.: US 7,506,706 B2
(45) Date of Patent: Mar. 24, 2009

(54) RETAINING ELEMENT FOR A JACK ELEMENT

(76) Inventors: David R. Hall, 2185 S. Larsen Pkwy., Provo, UT (US) 84606; Francis Leany, 2185 S. Larsen Pkwy., Provo, UT (US) 84606; Joe Fox, 2185 S. Larsen Pkwy., Provo, UT (US) 84606; Tyson J. Wilde, 2185 S. Larsen Pkwy., Provo, UT (US) 84606; Boyd Black, 2185 S. Larsen Pkwy., Provo, UT (US) 84606

( * ) Notice: Subject to any disclaimer, the term of this patent is extended or adjusted under 35 U.S.C. 154(b) by 104 days.

(21) Appl. No.: 11/774,645

(22) Filed: Jul. 9, 2007

(65) Prior Publication Data

US 2008/0011521 A1 Jan. 17, 2008

Related U.S. Application Data

(63) Continuation-in-part of application No. 11/759,992, filed on Jun. 8, 2007, and a continuation-in-part of application No. 11/750,700, filed on May 18, 2007, which is a continuation-in-part of application No. 11/737,034, filed on Apr. 18, 2007, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, application No. 11/774,645, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, which is a continuation-in-part of application No. 11/306,976, filed on Jan. 18, 2006, which is a continuation-in-part of application No. 11/306,307, filed on Dec. 22, 2005, which is a continuation-in-part of application No. 11/306,022, filed on Dec. 14, 2005, which is a continuation-in-part of application No. 11/164,391, filed on Nov. 21, 2005.

(51) Int. Cl.
*E21B 21/26* (2006.01)

(52) U.S. Cl. ..... 175/385; 175/327

(58) Field of Classification Search ..... 175/73, 175/385, 327
See application file for complete search history.

(56) References Cited

U.S. PATENT DOCUMENTS 3,667,556 A * 6/1972 Henderson ..... 175/73
4,836,301 A * 6/1989 Van Dongen et al. ..... 175/61

(Continued)

*Primary Examiner*—Hoang Dang
(74) *Attorney, Agent, or Firm*—Tyson J. Wilde

(57) ABSTRACT

A drill bit having a bit body intermediate a shank and a working face having at least one cutting insert. A bore is formed in the working face co-axial within an axis of rotation of the drill bit. A jack element is retained within the bore by a retaining element that intrudes a diameter of the bore.

19 Claims, 4 Drawing Sheets

U.S. PATENT DOCUMENTS 4,938,297 A * 7/1990 Schmidt ..... 175/19
5,099,927 A * 3/1992 Gibson et al. ..... 175/45
2004/0238221 A1 * 12/2004 Runia et al. ..... 175/61

* cited by examiner

RETAINING ELEMENT FOR A JACK ELEMENT

CROSS REFERENCE TO RELATED APPLICATIONS

This Patent Application is a continuation-in-part of U.S. patent application Ser. No. 11/759,992 which was filed on Jun. 8, 2007. This application is also a continuation-in-part of U.S. patent application Ser. No. 11/750,700 filed on May 18, 2007. U.S. patent application Ser. No. 11/750,700 a continuation-in-part of U.S. patent application Ser. No. 11/737,034 filed on Apr. 18, 2007. U.S. patent application Ser. No. 11/737,034 is a continuation-in-part of U.S. patent application Ser. No. 11/686,638 filed on Mar. 15, 2007 now U.S. Pat. No. 7,424,922. U.S. patent application Ser. No. 11/686,638 is a continuation-in-part of U.S. patent application Ser. No. 11/680,997 filed on Mar. 1, 2007 now U.S. Pat. No. 7,419,016. U.S. patent application Ser. No. 11/680,997 is a continuation-in-part of U.S. patent application Ser. No. 11/673,872 filed on Feb. 12, 2007 now U.S. Pat. No. 7,484,576. U.S. patent application Ser. No. 11/673,872 is a continuation-in-part of U.S. patent application Ser. No. 11/611,310 filed on Dec. 15, 2006. This Patent Application is also a continuation-in-part of U.S. patent application Ser. No. 11/278,935 filed on Apr. 6, 2006 now U.S. Pat. No. 7,426,968. U.S. patent application Ser. No. 11/278,935 is a continuation-in-part of U.S. patent application Ser. No. 11/277,394 which filed on Mar. 24, 2006 now U.S. Pat. No. 7,398,837. U.S. patent application Ser. No. 11/277,394 is a continuation-in-part of U.S. patent application Ser. No. 11/277,380 also filed on Mar. 24, 2006. U.S. patent application Ser. No. 11/277,380 is a continuation-in-part of U.S. patent application Ser. No. 11/306,976 which was filed on Jan. 18, 2006. U.S. patent application Ser. No. 11/306,976 is a continuation-in-part of 11/306,307 filed on Dec. 22, 2005. U.S. patent application Ser. No. 11/306,307 is a continuation-in-part of U.S. patent application Ser. No. 11/306,022 filed on Dec. 14, 2005. U.S. patent application Ser. No. 11/306,022 is a continuation-in-part of U.S. patent application Ser. No. 11/164,391 filed on Nov. 21, 2005. All of these applications are herein incorporated by reference in their entirety.

BACKGROUND OF THE INVENTION

This invention relates to drill bits, specifically drill bit assemblies for use in oil, gas and geothermal drilling. Drill bits are continuously exposed to harsh conditions during drilling operations in the earth's surface. Bit whirl in hard formations for example may result in damage to the drill bit and reduce penetration rates. Further loading too much weight on the drill bit when drilling through a hard formation may exceed the bit's capabilities and also result in damage. Too often unexpected hard formations are encountered suddenly and damage to the drill bit occurs before the weight on the drill bit may be adjusted. When a bit fails it reduces productivity resulting in diminished returns to a point where it may become uneconomical to continue drilling. The cost of the bit is not considered so much as the associated down time required to maintain or replace a worn or expired bit. To replace a bit requires removal of the drill string from the bore in order to service the bit which translates into significant economic losses until drilling can be resumed.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a down hole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

A drill bit comprising a bit body intermediate a shank and a working face comprising at least one cutting insert. A bore is formed in the working face co-axial within an axis of rotation of the drill bit. A jack element is retained within the bore by a retaining element that intrudes a diameter of the bore.

The jack element may comprise a polygonal or cylindrical shaft. A distal end may comprise a domed, rounded, semi-rounded, conical, flat, or pointed geometry. The shaft diameter may be 50 to 100% a diameter of the bore. The jack element may comprise a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof.

In some embodiments, the jack element may comprise a coating of abrasive resistant material comprised of a material selected from the following including natural diamond, polycrystalline diamond, boron nitride, tungsten carbide or combinations thereof The coating of abrasion resistant material comprises a thickness of 0.5 to 4 mm.

The retaining element may be a cutting insert, a snap ring, a cap, a sleeve or combinations thereof. The retaining element may comprise a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof.

In some embodiments, the retaining element may intrude a diameter of the shaft. The retaining element may be disposed at a working surface of the drill bit. The retaining element may also be disposed within the bore. The retaining element may be complimentary to the jack element and the retaining element may have a bearing surface.

In some embodiments, the drill bit may comprise at least one electric motor. The at least one electric motor may be in mechanical communication with the shaft and may be adapted to axially displace the shaft.

The at least one electric motor may be powered by a turbine, a battery, or a power transmission system from the surface or down hole. The at least one electric motor may be in communication with a down hole telemetry system. The at least one electric motor may be an AC motor, a universal motor, a stepper motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly-fed motor, or combinations thereof.

DETAILED DESCRIPTION OF THE INVENTION AND THE PREFERRED EMBODIMENT

Figure 1:
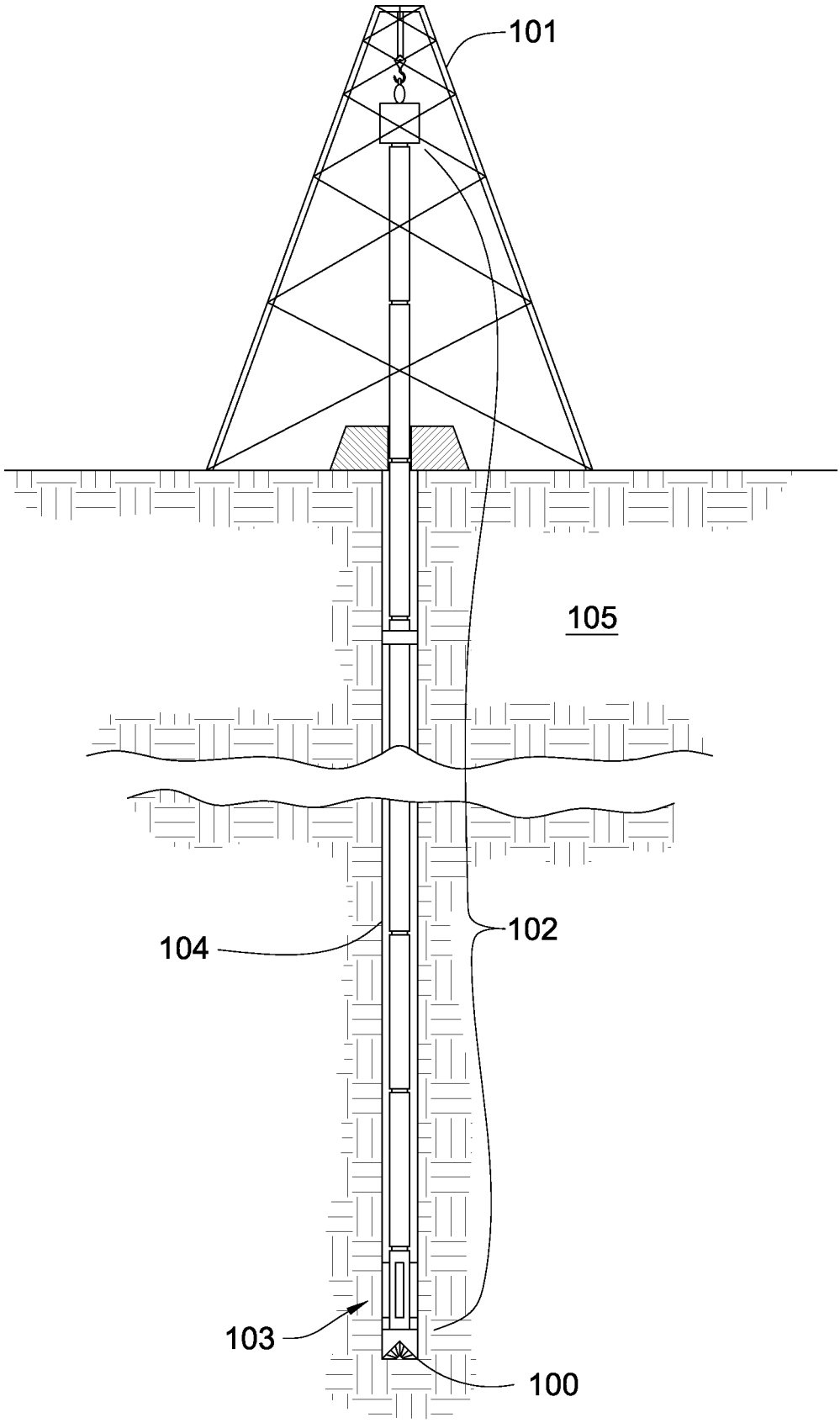
FIG. 1 is a perspective diagram of an embodiment of a drill string suspended in a bore hole.

Referring now to the figures, FIG. 1 is a perspective diagram of an embodiment of a drill string 102 suspended by a derrick 101. A bottom-hole assembly 103 is located at the bottom of a bore hole 104 and comprises a rotary drag bit 100. As the drill bit 100 rotates down hole the drill string 102 advances farther into the earth. The drill string 102 may penetrate soft or hard subterranean formations 105.

Figure 2:
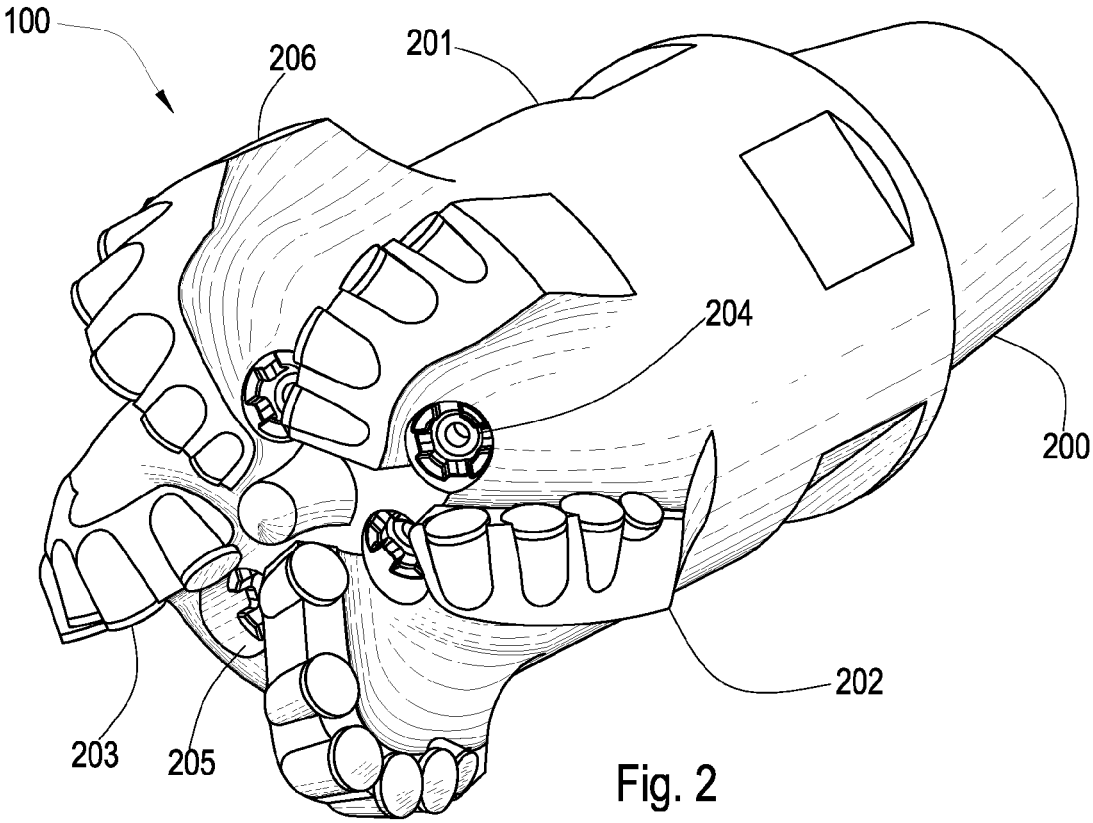
FIG. 2 is a perspective diagram of an embodiment of a drill bit.
Figure 3:
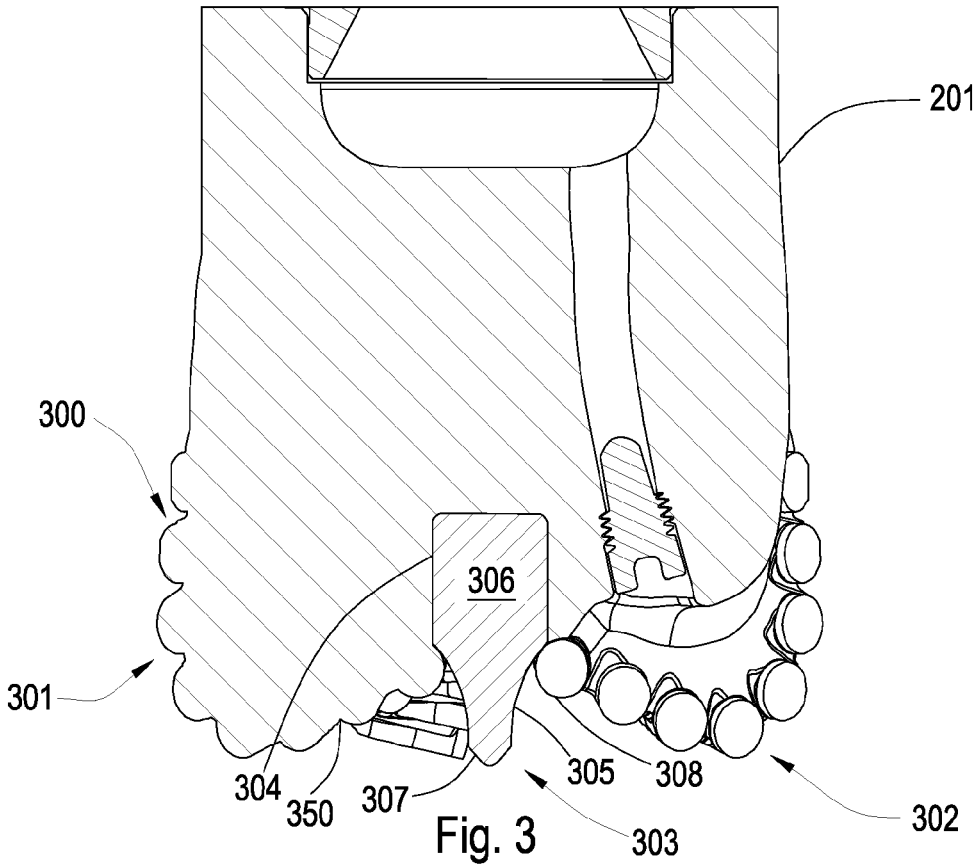
FIG. 3 is a cross-sectional diagram of an embodiment of a drill bit.

FIGS. 2 through 3 disclose a drill bit 100 of the present invention. The drill bit 100 comprises a shank 200 which is adapted for connection to a down hole tool string such as drill string 102 comprising drill pipe, drill collars, heavy weight pipe, reamers, jars, and/or subs. In some embodiments coiled tubing or other types of tool string may be used. The drill bit 100 of the present invention is intended for deep oil and gas drilling, although any type of drilling application is anticipated such as horizontal drilling, geothermal drilling, mining, exploration, on and off-shore drilling, directional drilling, water well drilling and any combination thereof. The bit body 201 is attached to the shank 200 and comprises an end which forms a working face 206. Several blades 202 extend outwardly from the bit body 201, each of which may comprise a plurality of cutting inserts 203. A drill bit 100 most suitable for the present invention may have at least three blades 202; preferably the drill bit 100 will have between three and seven blades 202. The blades 202 collectively form an inverted conical region 303. Each blade 202 may have a cone portion 350, a nose portion 302, a flank portion 301, and a gauge portion 300. Cutting inserts 203 may be arrayed along any portion of the blades 202, including the cone portion 350, nose portion 302, flank portion 301, and gauge portion 300. A plurality of nozzles 204 are fitted into recesses 205 formed in the working face 206. Each nozzle 204 may be oriented such that a jet of drilling mud ejected from the nozzles 204 engages the formation 105 before or after the cutting inserts 203. The jets of drilling mud may also be used to clean cuttings away from the drill bit 100. In some embodiments, the jets may be used to create a sucking effect to remove drill bit cuttings adjacent the cutting inserts 203 by creating a low pressure region within their vicinities.

The jack element 305 comprises a hard surface of at least 63 HRc. The hard surface may be attached to the distal end 307 of the jack element 305, but it may also be attached to any portion of the jack element 305. The jack element 305 may also comprise a cylindrical shaft 306 which is adapted to fit within a bore 304 disposed in the working face 206 of the drill bit 100. The jack element 305 may be retained in the bore through the use of at least one retaining element 308. The retaining element 308 may comprise a cutting insert 203, a snap ring, a cap, a sleeve or combinations thereof. The retaining element 308 retains the jack bit 305 in the bore 304 by intrusion of a diameter of the bore 304. FIGS. 2 through 3 disclose a drill bit 100 that utilizes at least one cutting insert 203 as a retaining element 308 to retain the jack element 305 within the bore 304. At least one of the retaining elements may intrude on the diameter by 0.010 to 1 inch. In some embodiments, the at least one retaining element may intrude by 0.300 to 0.700 inches into the bore diameter. In some embodiments, the retaining element intrudes by within 5 to 35 percent of the bore diameter.

In some embodiments, the jack element 305 is made of the material of at least 63 HRc. In the preferred embodiment, the jack element 305 comprises tungsten carbide with polycrystalline diamond bonded to its distal end 307. In some embodiments, the distal end 307 of the jack element 305 comprises a diamond or cubic boron nitride surface. The diamond may be selected from group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof. In some embodiments, the jack element 305 is made primarily from a cemented carbide with a binder concentration of 1 to 40 weight percent, preferably of cobalt.

The working face 206 of the drill bit 100 may be made of a steel, a matrix, or a carbide as well. The cutting inserts 203 or distal end 307 of the jack element 305 may also be made out of hardened steel or may comprise a coating of chromium, titanium, aluminum or combinations thereof.

One long standing problem in the industry is that cutting inserts 203, such as diamond cutting inserts 203, chip or wear in hard formations 105 when the drill bit 100 is used too aggressively. To minimize cutting insert 203 damage, the drillers will reduce the rotational speed of the bit 100, but all too often, a hard formation 105 is encountered before it is detected and before the driller has time to react. The jack element 305 may limit the depth of cut that the drill bit 100 may achieve per rotation in hard formations 105 because the jack element 305 actually jacks the drill bit 100 thereby slowing its penetration in the unforeseen hard formations 105. If the formation 105 is soft, the formation 105 may not be able to resist the weight on bit (WOB) loaded to the jack element 305 and a minimal amount of jacking may take place. But in hard formations 105, the formation 105 may be able to resist the jack element 305, thereby lifting the drill bit 100 as the cutting inserts 203 remove a volume of the formation 105 during each rotation. As the drill bit 100 rotates and more volume is removed by the cutting inserts 203 and drilling mud, less WOB will be loaded to the cutting inserts 203 and more WOB will be loaded to the jack element 305. Depending on the hardness of the formation 105, enough WOB will be focused immediately in front of the jack element 305 such that the hard formation 105 will compressively fail, weakening the hardness of the formation and allowing the cutting inserts 203 to remove an increased volume with a minimal amount of damage.

Figure 4:
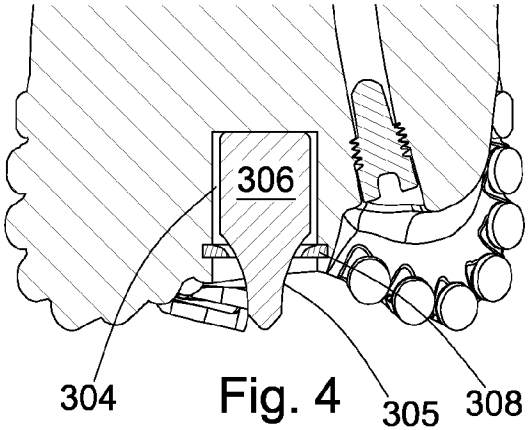
FIG. 4 is a cross-sectional diagram of another embodiment of a drill bit.

Now referring to various embodiments of the present invention as disclosed in FIG. 4 through 7. FIG. 4 discloses a drill bit 100 with a bore 304 disposed in the working face 206. The shaft 306 of the jack element 305 is disposed within the bore 304. At least one recess has been formed in the circumference of the bore 304 such that a snap ring may be placed within the bore 304 retaining the shaft 306 within the bore 304.

Figure 5:
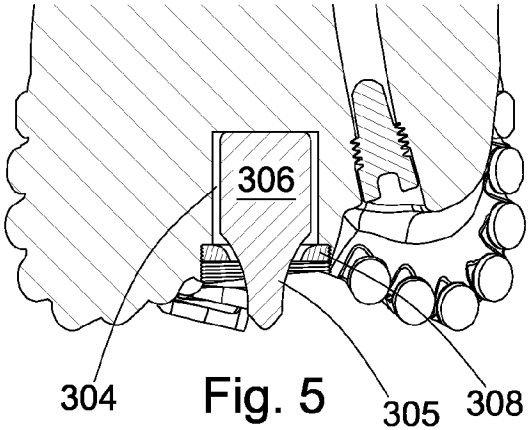
FIG. 5 is a cross-sectional diagram of another embodiment of a drill bit.
Figure 7:
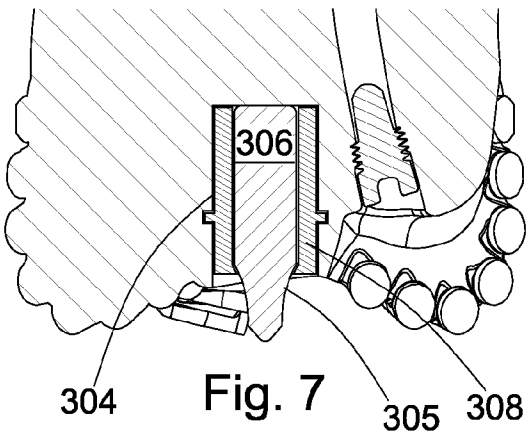
FIG. 7 is a cross-sectional diagram of another embodiment of a drill bit.

FIG. 5 discloses a jack element 305 retained in a bore 304 by a cap retaining element 308. The cap retaining element 308 may be threaded, brazed, bolted, riveted or press-fitted to the working surface 206 of the drill bit 100. The surface of the retaining element 308 may be complimentary to the jack element 305. The retaining element 308 may also have a bearing surface. In some embodiments the drill bit body is made of steel or matrix.

Figure 6:
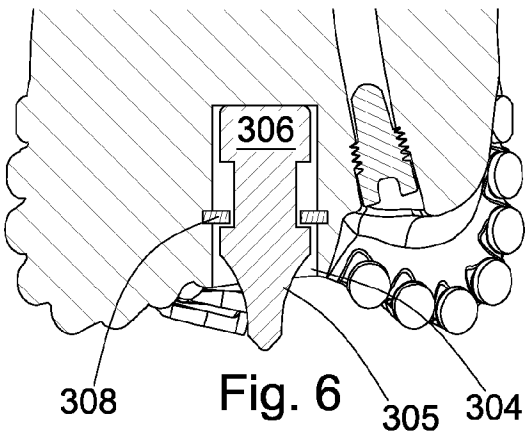
FIG. 6 is a cross-sectional diagram of another embodiment of a drill bit.

Now referring to FIG. 6, the shaft 306 may have at least one recess to accommodate the reception of the retaining element 308. The retaining element 308 is a snap ring that retains the jack bit 305 in the bore 304 by expanding into the recess formed in the bore 304 and into the recess formed in the shaft 306. A sleeve may be used as a retaining element 308 as disclosed in FIG. 7.

Figure 8:
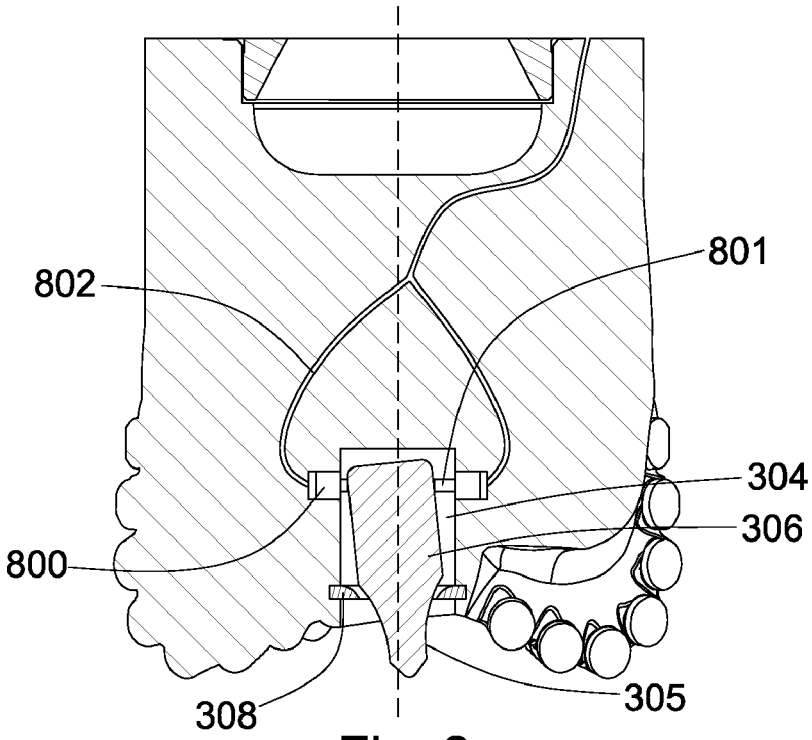
FIG. 8 is a cross-sectional diagram of another embodiment of a drill bit.
Figure 9:
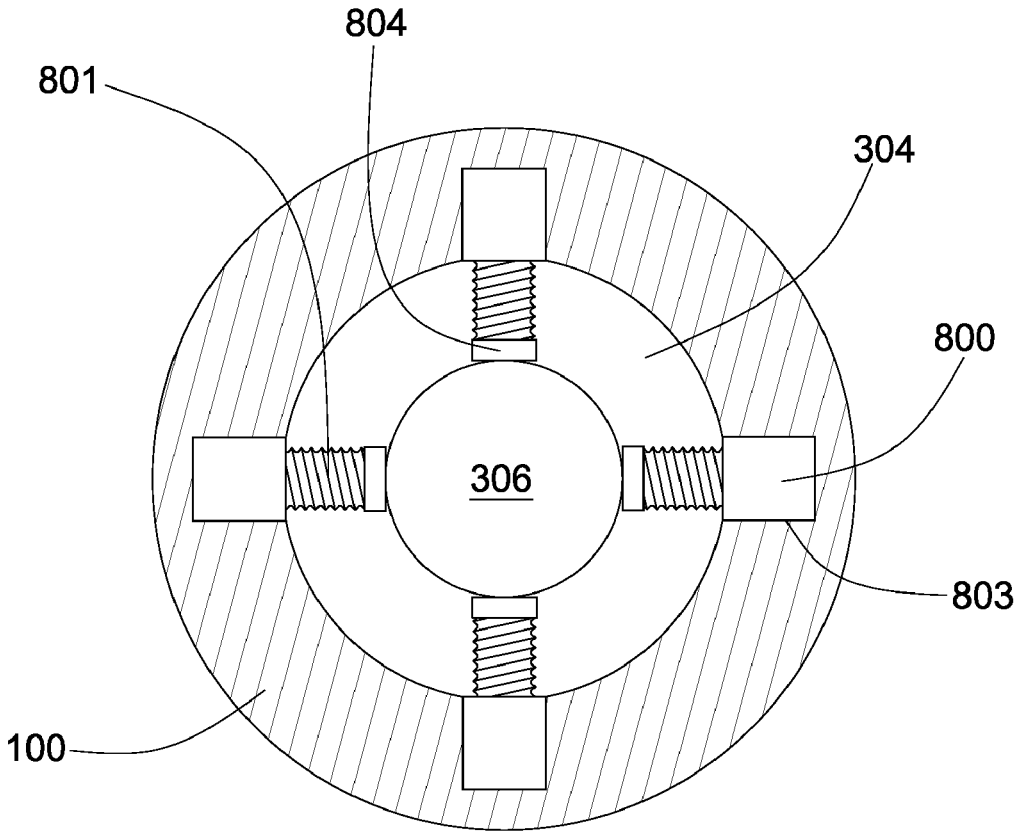
FIG. 9 is a cross-sectional diagram of an embodiment of a steering mechanism

The drill bit 100 may comprise a plurality of electric motors 800 adapted to alter the axial orientation of the shaft 306, as in the embodiment of FIGS. 8 and 9. The motors 800 may be disposed within recesses 803 formed within the bore 304 wall. They may also be disposed within a collar support secured to the bore 304 wall. The plurality of electric motors may comprise an AC motor, a universal motor, a stepper motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly- fed motor, or combinations thereof.

Each electric motor 800 may comprise a protruding threaded pin 801 which extends or retracts according to the rotation of the motor 800. The threaded pin 801 may comprise an end element 804 such that the shaft 306 is axially fixed when all of the end elements 804 are contacting the shaft 306. The axial orientation of the shaft 306 may be altered by extending the threaded pin 801 of one of the motors 800 and retracting the threaded pin 801 of the other motors 800. Altering the axial orientation of the shaft 306 may aid in steering the tool string 102.

The electric motors 800 may be powered by a turbine, a battery, or a power transmission system from the surface or down hole. The electric motors 800 may also be in communication 802 with a downhole telemetry system.

Whereas the present invention has been described in particular relation to the drawings attached hereto, it should be understood that other and further modifications apart from those shown or suggested herein, may be made within the scope and spirit of the present invention.

What is claimed is:

1. A drill bit comprising;

a bit body intermediate a shank and a working face comprising at least one cutting insert;

a bore formed in the working face co-axial within an axis of rotation of the drill bit, and a jack element retained within the bore by a retaining element that intrudes a diameter of the bore;

wherein the retaining element is at least partial attached to the working surface of the drill bit.

2. The bit of claim 1, wherein the retaining element is a cutting insert, a snap ring, a cap, a sleeve or combinations thereof.

3. The bit of claim 1, wherein the jack element comprises a polygonal shaft.

4. The bit of claim 1, wherein the retaining element intrudes a diameter of the jack element.

5. The bit of claim 1, wherein the retaining element comprises a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof.

6. The bit of claim 1, wherein the retaining element is disposed within the bore.

7. The bit of claim 1, wherein the retaining element is complimentary to the jack element.

8. The bit of claim 1, where in the retaining element has a bearing surface.

9. The bit of claim 1, wherein the jack element comprises a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof.

10. The bit of claim 1, wherein the jack element comprises a coating of abrasive resistant material comprised of a material selected from the following including natural diamond, polycrystalline diamond, boron nitride, tungsten carbide or combinations thereof.

11. The bit of claim 10, wherein a coating of abrasion resistant material comprises a thickness of 0.5 to 4 mm.

12. The bit of claim 1, wherein the jack element comprises a distal end comprising a domed, rounded, semi-rounded, conical, flat, or pointed geometry.

13. The bit of claim 1, wherein a diameter of the jack element is 50 to 100% a diameter of the bore.

14. The bit of claim 1, wherein the drill bit comprises at least one electric motor.

15. The bit of claim 1, wherein the jack element is in mechanical communication with a at least one electric motor.

16. The bit of claim 1, where in the at least one electric motor is adapted to axially displace the shaft.

17. The bit of claim 16, wherein the at least one electric motor is powered by a turbine, a battery, or a power transmission system from the surface or down hole.

18. The bit of claim 16, wherein the at least one electric motor is in communication with a down hole telemetry system.

19. The bit of claim 16, wherein the at least one electric motor is an AC motor, a universal motor, a stepper motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly- fed motor, or combinations thereof.

* * * * *